United States Patent [19]

Pritchard

[11] Patent Number: 4,800,847

[45] Date of Patent: Jan. 31, 1989

[54] ANAEROBIC OPERATION OF AN INTERNAL COMBUSTION ENGINE

[76] Inventor: Huw O. Pritchard, R.R. #1, Bolton, Ontario, Canada, L7E 5R7

[21] Appl. No.: 58,816

[22] Filed: Jun. 5, 1987

[51] Int. Cl.[4] ..... F02B 75/12

[52] U.S. Cl. ..... 123/1 A; 44/68

[58] Field of Search ..... 123/1 A; 44/68, 66, 44/57

[56] References Cited

U.S. PATENT DOCUMENTS

| | | | |
|---|---|---|---|
| 2,838,034 | 6/1956 | Clark | 123/1 A |
| 3,897,757 | 8/1975 | Abello | 123/1 A |
| 4,002,151 | 1/1977 | Toyoda et al. | 123/1 A |
| 4,091,769 | 5/1978 | Baldwin | 123/1 A |
| 4,182,278 | 1/1980 | Coakwell | 123/1 A |
| 4,222,351 | 9/1980 | Kosaka et al. | 123/3 |
| 4,248,182 | 2/1981 | Malec | 123/1 A |
| 4,359,969 | 11/1982 | Mellovist et al. | 123/1 A |
| 4,398,505 | 8/1983 | Cahill | 123/1 A |
| 4,494,488 | 1/1985 | Wheatley | 123/1 A |
| 4,520,763 | 6/1985 | Lynch et al. | 123/1 A |
| 4,572,140 | 2/1986 | Wheatley | 123/1 A |
| 4,659,335 | 4/1987 | Wegner et al. | 123/1 A |

*Primary Examiner*—E. Rollins Cross

*Attorney, Agent, or Firm*—Mason, Fenwick & Lawrence

[57] ABSTRACT

A process for running an internal combustion engine is disclosed. The process comprises running the engine in communication with ambient air and with a fuel that is, at the compression ratio of the engine, capable of undergoing combustion in air containing a sufficient amount of oxygen for combustion and of undergoing spontaneous explosion in the absence of sufficient oxygen in said air for combustion.

12 Claims, No Drawings

ANAEROBIC OPERATION OF AN INTERNAL COMBUSTION ENGINE

BACKGROUND OF THE INVENTION

This invention relates to internal combustion engines, and more particularly to the anaerobic operation of an internal combustion engine.

Conventional engines generally can only operate efficiently when there is sufficient oxygen in the ambient air for aerobic combustion of the fuel. Thus, conventional internal combustion engines do not perform satisfactorily under certain oxygen-deficient conditions where it is desirable to use them. For example, when fighting fires in enclosed structures or mines, there may be insufficient oxygen (i.e. less than 17%) in the ambient air to operate conventional chain saws. These chain saws are desired to be used to cut holes in walls in enclosed structures or to cut conveyor belts or fell timbers in mines to prevent the propagation of fire to other sections of the mine. Also, in mine rescue operations, diesel engines are used to drive foam generators and to drive pumps for firefighting purposes. These engines also cannot operate satisfactorily under low oxygen conditions which may occur in the mine.

SUMMARY OF THE INVENTION

It is an object of the present invention to obviate or migitate the above-mentioned disadvantages.

Accordingly, the invention provides a process for running an internal combustion engine comprising running the engine in communication with ambient air and with a fuel that is capable, at the compression ratio of the engine, of undergoing combustion in air containing a sufficient amount of oxygen for combustion and of undergoing spontaneous explosion in the absence of sufficient oxygen in said air for combustion.

In another one of its aspects, the invention provides a combination comprising an internal combustion engine in communication with ambient air and a fuel to be introduced into the engine. The fuel is capable, at the compression ratio of the engine, of undergoing combustion in air containing sufficient oxygen for combustion and of undergoing spontaneous explosion in the absence of sufficient oxygen in said air for combustion.

With the present invention, an internal combustion engine can be operated under both aerobic conditions and under conditions wherein there is insufficient oxygen for combustion. Generally, the speed will be somewhat slower when the engine is operated under conditions of insufficient oxygen, however, this can be compensated for by manually adjusting the throttle setting or by automatic control of the engine speed.

DESCRIPTION OF THE PREFERRED EMBODIMENTS

Preferably the fuel is an exothermic organic compound selected from organic peroxides, hydroperoxides, organic nitrates, organic nitro-compounds, organic azides, organic azo-compounds, ethylene oxide and propylene oxide. However, as one skilled in the art is aware, many organic peroxy molecules are dangerously explosive, so that safety considerations would be paramount in choosing the best ones for practical use. Di-tert-butyl peroxide, tert-butyl hydroperoxide, ethylene oxide and propylene oxide are readily available materials which do not present serious safety problems, and thus are the particularly preferred fuels for use with the present invention. The nitrogen-containing substances mentioned above are somewhat less attractive because they may generate noxious exhaust gases under both aerobic and anaerobic conditions. The main criteria for choosing the fuel are that it should be stable at storage temperatures, should be capable of exploding spontaneously at the elevated temperatures achieved in the engine compression, should burn well in air so that the engine can be run in a normal manner when there is sufficient oxygen and should be handlable relatively safely by appropriately trained operators.

The compression ratio of the engine is selected based on the type of machine that the engine is to operate. For stationary machines, the compression ratio is selected such that the temperature of the fuel and ambient air mixture can be raised to a value at which the fuel will substantially decompose in a maximum time of the order of 5 milliseconds (corresponding to a speed of 400–500 r.p.m.). For hand-held machines, such as a chain saw, the maximum decomposition time is in the order of 1 millisecond (corresponding to a speed of 2000 r.p.m.).

The required compression ratio for a given fuel can be estimated by calculating the temperature achieved in the compression by the standard gas-law expression for adiabatic heating (neglecting heat losses) and by computing the rate of decomposition using the standard Arrhenius gas law and the known Arrhenius rate parameters for the decomposition of the fuel.

When the fuel is di-tert-butyl peroxide, the appropriate compression ratio is of the order of 5.5. With gaseous substances such as ethylene oxide, the rate of thermal decomposition is much lower than that of liquid fuels such as di-tert-butyl peroxide, thus a compression ratio of about 20 is required to achieve the same results as with di-tert-butyl peroxide.

Substantially any type of engine can be used with the present invention, provided it has the appropriate compression ratio. If the fuel is liquid, it can be aspirated into the engine along with the air intake by using a conventional carburetor, or it may be injected into the compression-heated air as in a diesel engine. If the fuel is a gas, it may be introduced in the engine by standard techniques similar to those used in propane-fueled engines. Ignition may be initiated by an appropriately timed spark as in conventional engines, or spontaneously as in a diesel engine. A two-stroke or four-stroke engine can be used, however, with a two-stroke engine, it may be necessary to inject the oil and fuel separately, as some of the fuels appropriate for the present invention are powerful oxidizers and may oxidize the oil spontaneously.

The invention will now be described, by way of illustration only, with reference to the following example.

EXAMPLE

The method in accordance with a preferred embodiment of the invention was carried out using a conventional single-cylinder four-stroke spark engine of 100 cc nominal capacity and a compression ratio of about 5.5, with di-tert-butyl peroxide as the fuel. The engine was set to run at 900 r.p.m. with the carburetor intake being switchable between ambient air, a 1:1 air-nitrogen mixture, or pure nitrogen. With the 1:1 mixture, a small diminution in engine speed was observed, but with pure nitrogen, the speed fell to some 250–300 r.p.m. The explanation for the drop in speed to 250 r.p.m. is that with the compression ratio of 5.5, the temperature achieved in the cylinder by adiabatic compression is such that the peroxide is estimated to decompose thermally in a time of the order of 10 milliseconds, corresponding to a speed of about 250 r.p.m. The engine will run indefinitely in spark assisted mode under anaerobic conditions, but will run only feebly when the spark plug is grounded. Thus the invention can be implemented with either conventional spark ignition or diesel engines.

We claim:

1. A process for running an internal combustion engine comprising running said engine in communication with ambient air and with a fuel that is capable, at the compression ratio of said engine, of undergoing combustion air containing a sufficient amount of oxygen for combustion and of undergoing spontaneous explosion in the absence of sufficient oxygen in said air for combustion

2. The process of claim 1 wherein said fuel is an exothermic organic compound.

3. The process of claim 2 wherein said exothermic organic compound is selected from organic peroxides, hydroperoxides, organic nitrates, organic nitro-compounds, organic azides, organic azo-compounds, ethylene oxide and propylene oxide.

4. The process of claim 3 wherein said fuel is selected from di-tert-butyl peroxide, tert-butyl hydroperoxide, ethylene oxide and propylene oxide.

5. The process of claim 4 wherein said fuel is di-tert-butyl peroxide.

6. The process of claim 1 wherein said engine is used to operate a stationary machine and said compression ratio is such that the temperature of the fuel and ambient air mixed therewith can be raised to a value at which the fuel will completely decompose in a time of the order of 5 milliseconds when there is insufficient oxygen for combustion.

7. The process of claim 1 wherein said engine is used to operate a hand-held machine and said compression ratio is such that the temperature of the fuel and ambient air mixed therewith can be raised to a value at which the fuel will completely decompose in a time of the order of 1 millisecond when there is insufficient oxygen for combustion.

8. The process of claim 1 wherein said fuel is di-tert-butyl peroxide and the compression ratio is of the order of 5.5.

9. The process of claim 1 wherein the fuel is ethylene dioxide and the compression ratio is about 20.

10. The process of claim 1 wherein said engine is selected from a spark-ignited engine and a diesel engine.

11. The process of claim 1 wherein said engine is selected from a 2-stroke engine and a four-stroke engine.

12. A combination comprising an internal combustion engine in communication with ambient air and a fuel to be introduced into said engine, said fuel being capable of undergoing combustion in air containing sufficient oxygen for combustion and also being capable of undergoing spontaneous combustion at an elevated temperature in the absence of sufficient oxygen in said air for combustion at the compression ratio of said engine.

* * * * *